United States Patent [19]

Melka, Jr. et al.

[11] 4,435,258

[45] Mar. 6, 1984

[54] METHOD AND APPARATUS FOR THE RECOVERY OF PALLADIUM FROM SPENT ELECTROLESS CATALYTIC BATHS

[75] Inventors: James P. Melka, Jr., Henrico County; John F. Barnes, Glen Allen, both of Va.

[73] Assignee: Western Electric Co., Inc., New York, N.Y.

[21] Appl. No.: 426,054

[22] Filed: Sep. 28, 1982

[51] Int. Cl.[3] ..... C25C 1/20

[52] U.S. Cl. ..... 204/109; 204/47; 204/130

[58] Field of Search ..... 204/109, 47, DIG. 13, 204/302, 130, 111

[56] References Cited

U.S. PATENT DOCUMENTS

| | | | |
|---|---|---|---|
| 3,011,920 | 12/1961 | Shipley, Jr. | 117/213 |
| 3,656,939 | 4/1972 | Boehm et al. | 75/108 |
| 3,672,938 | 6/1972 | Zeblisky | 117/47 A |
| 3,933,602 | 1/1976 | Henzi et al. | 204/44 |
| 3,961,943 | 6/1976 | Schell, Jr. | 75/108 |
| 3,980,531 | 9/1976 | Ludwig et al. | 204/43 R |
| 4,041,126 | 8/1977 | Baltz et al. | 423/22 |

*Primary Examiner*—Brian E. Hearn
*Assistant Examiner*—Gerard P. Rooney
*Attorney, Agent, or Firm*—J. F. Spivak

[57] ABSTRACT

A method is described for recovering palladium from spent catalytic colloidal palladium baths by dissolving the palladium to form a true solution followed by electrodeposition employing a nickel anode and a nickel or copper cathode.

11 Claims, 2 Drawing Figures

METHOD AND APPARATUS FOR THE RECOVERY OF PALLADIUM FROM SPENT ELECTROLESS CATALYTIC BATHS

TECHNICAL FIELD

This invention relates to a method and apparatus for recovering palladium from spent electroless catalytic baths containing colloidal palladium and more particularly to a method of recovery of such palladium by means of electrowinning.

BACKGROUND OF THE INVENTION

In the manufacture of printed wiring boards or other articles requiring electroless plating on a non-metallic substrate, a palladium colloidal catalyst is often employed to initiate the autocatalytic (electroless) plating on the substrate. Quite often, metal, e.g., copper, is present on the substrate when it is immersed in the catalytic bath. For example, when employing copper clad substrates which are drilled to provide through-holes, these through-holes must be metal plated to provide a continuous current path. Since the exposed surface in the hole is non-metallic, electroless plating techniques including the step of catalyzation by means of a tin/palladium colloidal catalyst is generally employed. Copper clad boards are immersed in the catalytic bath to deposit the catalyst thereon.

It has been found that with continued use, the catalytic bath becomes contaminated with copper from the copper cladding. When contamination reaches an extent such that the bath becomes ineffective or the electroless plating becomes less adherent than desirable, the bath is said to be "spent" and must then be discarded as waste.

Previously, such waste baths have been combined with other plant waste which are either discarded or treated for metal recovery.

It would be desirable, however, due to the relatively high value of palladium, to be able to effectively and relatively inexpensively recover the palladium from the spent catalytic baths in a form to allow it to be easily refined prior to its combination with other waste products.

SUMMARY OF THE INVENTION

Palladium is recovered from a spent catalytic bath essentially comprising an aqueous hydrochloric acid solution formed from mixing a relatively small quantity of palladium chloride with a relatively large quantity of tin chloride in a strong hydrochloric acid solution so as to form a palladium colloid together with contaminants derived during use of the bath. The recovery includes the steps of (a) dissolving the colloidal palladium in the bath so as to form a true solution by the addition of an oxidizing agent, e.g., hydrogen peroxide, to the bath; (b) heating the bath to a temperature and for a time sufficient to essentially remove excess hydrogen peroxide; (c) placing the solution in an electrolytic cell having (1) a nickel anode, and (2) a cathode comprised of a metal or metallic surface which is non-contaminating or easily separable from the palladium to be deposited; and (d) electrowinning palladium from the solution onto the cathode at a voltage which tends to minimize and substantially reduce tin deposits.

The invention also includes an electrolytic cell useful in the practice of the above-stated method.

DETAILED DESCRIPTION

Typical catalyst solutions used for the electroless deposition of metal such as copper and nickel are described in U.S. Pat. No. 3,011,920, issued to C. R. Shipley, Jr. Such catalysts are commercially available. Generally, these catalyst contain colloidal palladium in an aqueous hydrochloric acid solution which also contains a soluble tin compound. The tin may also be present as part of the colloid. Typically, the catalyst is made by combining hydrochloric acid, palladium chloride and tin chloride so as to form the colloidal palladium catalyst. Generally, the quantity of tin in the catalytic bath ranges from about 10 to 50 or more times the amount of palladium in the bath. During use of the catalytic bath, the bath becomes contaminated with metals which dissolve in the bath. For example, when catalyzing through-holes in a copper clad printed wiring board, copper from the copper cladding enters into and contaminates the colloidal catalytic bath. Eventually this bath becomes spent and must be discarded as waste. Due to the high value of palladium it is desirable to recover the palladium from the bath.

In accordance with the invention herein, the palladium is recovered by adding an oxidizing agent, e.g., hydrogen peroxide to the bath so as to form a true solution containing palladium chloride, removing the excess oxidizing agent, and then electrowinning the palladium from the solution. During the electrowinning process, enhanced plating of palladium occurs with some extraneous plating of copper, electrode material and tin so as to form a plated deposit on the cathode which is adequately concentrated in palladium so as to be suitable for refining by a commercial refiner. Further, palladium is formed on the anode due to a replacement reaction. The deposit is generally at least 100 times and as much as 1500 times more concentrated in palladium relative to the other metals as compared with the relative concentration of palladium in the catalytic bath.

Figure 1:
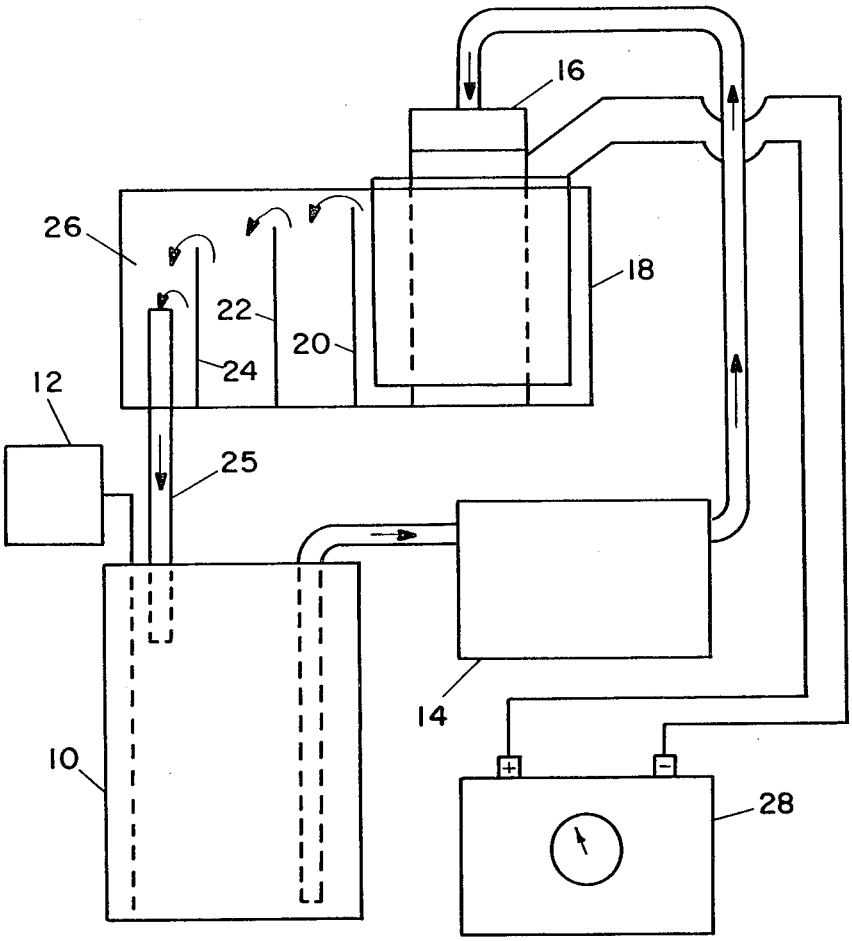
FIG. 1 is a block diagram indicating the components of the apparatus used for the electrolytic recovery of palladium.

Referring to FIG. 1, a schematic diagram of the apparatus used in the practice of the invention is shown. In accordance with the Figure, a sump 10 is provided into which the spent catalytic bath is placed. After placing the spent bath in the sump, hydrogen peroxide, preferably as concentrated (30%) hydrogen peroxide solution, is added to the sump 10 in a quantity sufficient to cause all of the colloidal palladium to dissolve. The solution in the sump 10 is then heated and aerated by means of an air pump 12 so as to remove unreacted excess peroxide. Continued aeration also helps to prevent the reprecipitation of palladium. Thereafter, the solution is allowed to cool and pumped, e.g., by means of a peristaltic pump 14, from the sump 10, through a cylindrical manifold 16 and into an electrolytic cell 18. The electrolytic cell 18 contains a plurality of cascade walls 20, 22 and 24 over which the solution flows. In the portion of the cell 26, after the last cascade wall 24, is a return duct 25 for returning the solution back to the sump 10 so as to provide a continually circulating system. A DC power supply 28 is provided for supplying a voltage to the electrodes of the electrolytic cell 18.

Figure 2:
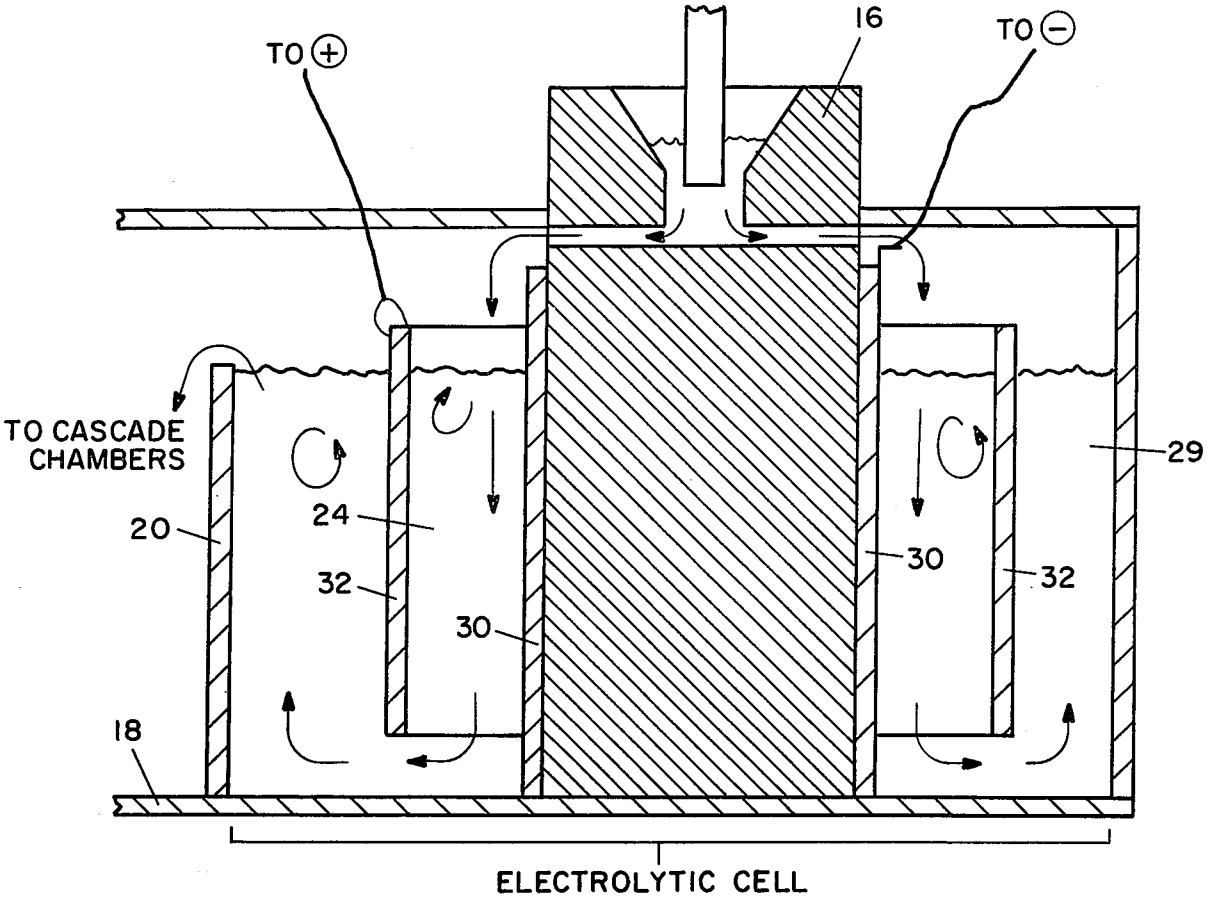
FIG. 2 is a cross section of the electrolytic cell of the apparatus shown in FIG. 1.

A more detailed diagram of the electrolytic cell 18 of the apparatus is shown in FIG. 2. As can be seen from this Figure, electrolyte solution 29 from the pump 14 flows into the manifold 16 which distributes the solution 29 around a cylindrical cathode 30. The cathode material should be one which preferably does not further contaminate the solution 29 and is also readily separable from the palladium to be deposited thereon. The preferred cathode materials are copper and nickel. The solution 29 flows between the cathode 30 and a cylindrical nickel anode 32 which surrounds the cathode 30. The anode 32 is raised from the floor of the cell 18 so that the solution 29 flows to the outside of the anode 32 and thence over the series of cascade walls 20, 22 and 24. Preferably, each cascade wall is somewhat lower than the prior cascade wall. The last chamber 26 of the cell contains the return duct 25 for returning the solution back to the sump 10.

The nickel anode 32 enters a replacement reaction with the palladium in solution as to become coated with palladium, thus reducing the activity of the anode in the solution and thereby reducing the rate of dissolution of the anode during electrowinning. It was unexpectedly found that the nickel ions resulting from replacement and dissolution of the nickel anode do not tend to plate-out readily at the voltages employed for the plating of the palladium. This reduces or minimizes any contamination of the resultant palladium deposit by virture of the anode. Further, it has been found that the nickel anode reacts at rate with the plating bath which is relatively slow so that its dissolution due to the acid in the bath is not overly competitive with the replacement reaction with palladium. While one would ordinarily think copper or a noble metal would be a preferred anode material, the palladium replacement reaction on the copper is not as uniform or as fast as on the nickel and further, copper from the solution tends to deposit more than nickel at the voltages employed for palladium deposition leading to greater copper contamination of the deposited palladium. In the case of a noble metal anode, e.g., platinum, it was unexpectedly discovered that the voltage required to deposit palladium led to much gas formation and high tin-containing deposits with relatively low palladium deposition. During the actual electrowinning or electrodeposition of the palladium the voltage across the novel electrolytic cell is closely controlled so as to insure a more selective deposition of the palladium resulting in a far greater proportion of palladium in the deposit than its proportion in the solution.

After prolonged electrodeposition, the deposits are rinsed by draining and flushing the cell and then collected for further refinement by smelting or other refining techniques.

Due to the constant flow of solution through the electrolytic cell there is a tendency for deposited palladium to break away from the cathode. By employing the cascade design as shown, the solid material is prevented from returning to the sump and remains in the electrolytic cell and recovered in the rinsing operation.

EXAMPLE I

Four and one-half gallons of a used colloidal palladium catalytic bath were placed into the sump. Five hundred ten millimeters of a 30% hydrogen peroxide solution were added to the sump to cause this solution of the colloidal palladium in the acidic catalytic bath. The solution in the sump was heated and aerated to drive off excess peroxide and then allowed to cool. A liquid sample (L-1) was drawn and analyzed for palladium content. The electrodes were prepared by washing the nickel anode in detergent and then cleaning the anode with a dilute mixed hydrochloric-nitric acid solution. The copper cathode was washed in detergent and cleaned with a mild acidic peroxide etchant. The inner surface of the cathode was mashed with platers tape and the electrodes were positioned in the electrolytic recovery cell. The pump was started so as to circulate the solution through the recovery cell and back to the sump. During this time, replacement of the nickel anode by palladium in solution was initiated. Electrolysis was then begun at a cathodic current density of about 10 amperes per square foot which was maintained for the balance of the experiment. This corresponded to about 0.25 volts at 24° C. Electrolysis was carried out for a total of about 72 consecutive hours. During this time period, routine functions were performed such as the addition of small amounts (50 ml or less) of 30% hydroxide added to the sump when it appeared the solution was regenerating the colloid. This peroxide addition redissolved the colloid and maintained the palladium in solution. Also, due to the use of a thin sheet of nickel as the anode material, the anode became dissolved from the combination of electrolysis and the replacement reaction with palladium. Consequently, a new anode had to be supplied. This, of course, could be eliminated by the use of a thicker nickel anode. In addition, liquid samples, L-2 and L-3 were drawn after about 1.5 hours and 25.5 hours of deposition, respectively, and was analyzed for palladium to gauge the completeness of the recovery.

At the termination of the electrolysis, the recovery cell was drained by returning the remaining solution of the sump. A fourth liquid sample, L-4, was drawn for analysis of palladium still left in solution. The electrolytic recovery cell was rinsed by recirculating deionized water through it. All deposited solids were removed from the electrolytic recovery cell and the nickel anodes were scraped so as to remove the palladium formed over the surface of the anode due to the replacement reaction. The copper cathode was dissolved with an ammonical etch and the remaining solids were collected by filtration. Further, all solids which had fallen to the bottom of the cascade chambers in the cell were collected. The solids were then combined, mixed, ground, dried and weighed. The solids were separated into three samples based upon predominant particle coarseness and each of these three samples was analyzed for metal content.

Table I, given below, sets forth the palladium, content in the electrolyte at various times during electrolysis and prior to electrolysis. As can be seen, the palladium content in the solution was decreased from 407 parts per million prior to electrolytic deposition to 7.2 parts per million, subsequent to deposition, thereby indicating that substantially all the palladium was removed from the solution by electrolytic deposition.

TABLE I

PROGRESSIVE ANALYSIS OF PALLADIUM CONTENT IN SOLUTION

| Sample Identification | Deposition Time (Hours) | Palladium Concentration (PPM) |
|---|---|---|
| L-1 | 0 | 407 |
| L-2 | 1.5 | 326 |
| L-3 | 26.5 | 70.6 |
| L-4 | 72 | 7.2 |

While the initial concentration of palladium in the solution was 407 parts per million, or approximately 0.04% palladium, Table II indicates that the palladium collected from the electrolysis was concentrated from the 0.04% level to 12.2% and to a mean average value of 10.4% palladium in the metal deposits, thereby increasing the palladium concentration by between 2 to 3 orders of magnitude.

TABLE II

| | WEIGHT PERCENT | | | | |
|---|---|---|---|---|---|
| SAMPLE | Pd | Cu | Sn | Ni | Fe |
| A | 12.2 | 81.3 | 4.7 | 0.2 | 0.02 |
| B | 10.4 | 79.3 | 6.5 | 0.2 | 0.03 |
| C | 8.4 | 78.6 | 6.7 | 0.2 | 0.03 |
| Avg. | 10.4 | 79.8 | 6.0 | 0.2 | 0.03 |

In comparison to the above results employing nickel as an anode, experiments were performed with other anodic materials. For example, when stainless steel was used as the anode, with a copper cathode and operating the cell at room temperature with a voltage of between 0.25 to 0.3 volts, the stainless steel dissolved and very little cathodic deposit was seen. Also, the solution turned very dark green, masking whether colloidal palladium was reforming. When platinum was used as an anode with either copper or nickel as a cathode material and the cell operating at room temperature, a voltage of at least 1.5 volts was required to obtain any cathodic deposit. The deposit which resulted only contained about 0.6% palladium and was predominantly tin, the tin content being about 69%. When similar cells were operated at 3 volts, again only about 0.6% palladium was recovered in the deposit while the tin content increased to 85%.

Experiments have shown that using high purity nickel as both the anode and cathode and operating the electrolytic cell at room temperature at voltages of between 0.25 to 0.3 volts, the resulting deposit which was achieved contained from 28–42% palladium depending on the source of the initial commercially available colloidal catalytic bath and the amount of contamination in the bath.

Further examples of experiments run in the laboratory and showing the palladium content of the combined electrolytically formed deposits using different catalytic baths and different electrode combinations as well as different oxidants are shown in Table III.

TABLE III

| | | | | Current | Analysis of Deposits (wt. %) | | | | |
|---|---|---|---|---|---|---|---|---|---|
| Expt. II | Oxidant | Anode | Cathode | Density | Pd | Sn | Cu | Fe | Ni |
| 1 | $H_2O_2$ | stainless steel | stainless steel | 5 amp/ft$^2$ | 0.62 | 96 | 1.9 | 0.06 | 2.4 |
| 2 | $H_2O_2$ | Monel | stainless steel | 21 amp/ft$^2$ | 3.68 | 65.7 | 24.22 | 0.05 | 6.35 |
| 3 | $H_2O_2$ | Ni | stainless steel | 25 amp/ft$^2$ | 3.75 | 73.89 | 16.64 | 0.19 | 5.53 |
| 4 | $H_2O_2$ | Ni | Cu | 15 amp/ft$^2$ | 29.89 | 18.12 | 30.57 | 0.05 | 2.26 |
| 5 | $KM_nO_4$ | Ni | Cu | 10 amp/ft$^2$ | 26.33 | 9.88 | 44.77 | 0.09 | 0.22 |
| 6 | $H_2O_2$ | Ni | Ni | 10 amp/ft$^2$ | 30.69 | 2.66 | 55.73 | 0.28 | |
| 7 | $H_2O_2$ | Ni | Ni | 10 amp/ft$^2$ | 42.27 | 11.89 | 41.74 | 0.24 | |
| 8 | $H_2O_2$ | Pt | Ni | 10 amp/ft$^2$ | 0.6 | 78.0 | 0.8 | 0.2 | |

It is to be understood that the above-described embodiments are simply illustrative of the principles of the invention. Various other modifications and changes may be devised by those skilled in the art which will embody the principles of the invention and fall within the spirit and scope thereof.

What is claimed is:

1. A method for recovering palladium from a tin-containing acidic colloidal palladium bath comprising the steps of:

(a) dissolving the colloidal palladium by the addition of an oxidizing agent to the bath;

(b) heating the solution containing the dissolved palladium;

(c) placing the solution in an electrolytic cell having a nickel anode and a cathode of nickel or copper; and (d) electrowinning palladium from the solution at a voltage and current density which tends to preferably plate palladium as opposed to any tin in the solution.

2. The method recited in claim 1, wherein the oxidizing agent is hydrogen peroxide.

3. The method recited in claim 1, wherein the solution is continuously recirculated through a sump while aerating the solution in the sump.

4. The method recited in claim 1, including the step of collecting essentially all deposits formed during electrodeposition.

5. The method recited in claim 4, including the step of separating the deposits from the base material of both the anode and the cathode.

6. The method recited in claim 5, whereby the deposit is separated from the cathode by dissolution of the cathode in a medium that does not dissolve the palladium deposit thereon.

7. The method recited in claim 6, wherein dissolution of the cathode is facilitated by masking a surface of the cathode prior to deposition and removing the mask subsequent to deposition.

8. The method recited in claim 7, wherein the cathode is copper foil.

9. A method of recovering palladium from a spent HCl, tin-containing colloidal catalytic palladium both comprising the steps of:

(a) placing the bath in a sump;

(b) dissolving the colloidal palladium by means of the addition of hydrogen peroxide to the bath to form a true solution;

(c) heating and aerating the bath to remove excess hydrogen peroxide;

(d) circulating the solution from the sump into an electrolytic cell having a nickel anode, a nickel or copper cathode, and means for preventing deposits formed from returning to the sump;

(e) electrowinning palladium from the solution at a voltage which tends to preferentially deposit palladium as compared to tin from the solution;

(f) adding small quantities of hydrogen peroxide to the sump, if needed to redissolve any colloid which reforms during electrowinning; and (g) collecting the palladium containing deposits in the cell.

10. A method for recovering palladium from a tin-containing acidic colloidal palladium bath comprising the steps of:

(a) dissolving the colloidal palladium by the addition of hydrogen peroxide to the bath;

(b) heating the solution containing the dissolved palladium to substantially remove excess hydrogen peroxide;

(c) placing the solution in an electrolytic cell having a nickel anode and a cathode of nickel or copper; and (d) electrowinning palladium from the solution at a voltage and current density which tends to preferably plate palladium as opposed to any tin in the solution.

11. The method recited in claim 10, including the step of adding small amounts of hydrogen peroxide as may be required during electrodeposition in order to redissolve any colloid which may reform.

* * * * *